US011078620B2

(12) United States Patent
Bensel et al.

(10) Patent No.: US 11,078,620 B2
(45) Date of Patent: Aug. 3, 2021

(54) DRYER SENSOR ROD WITH ORIENTED TAB

(71) Applicant: Haier US Appliance Solutions, Inc., Wilmington, DE (US)

(72) Inventors: Peter Hans Bensel, Louisville, KY (US); Robert V. MacDonald, III, Simpsonville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 36 days.

(21) Appl. No.: 16/513,853

(22) Filed: Jul. 17, 2019

(65) Prior Publication Data

US 2021/0017698 A1 Jan. 21, 2021

(51) Int. Cl.

| | |
|---|---|
| ***F26B 19/00*** | (2006.01) |
| ***D06F 58/30*** | (2020.01) |
| *D06F 58/38* | (2020.01) |
| *D06F 103/10* | (2020.01) |

(52) U.S. Cl.

CPC ..... *D06F 58/30* (2020.02); *D06F 58/38* (2020.02); *D06F 2103/10* (2020.02)

(58) Field of Classification Search

CPC ..... D06F 58/30; D06F 58/38; D06F 2103/10
USPC ..... 34/528, 73
See application file for complete search history.

(56) References Cited

U.S. PATENT DOCUMENTS

| | | | | |
|---|---|---|---|---|
| 3,593,571 | A | 7/1971 | Wiechert | |
| 2014/0144038 | A1* | 5/2014 | Santarossa | D06F 58/30 34/108 |
| 2020/0063330 | A1* | 2/2020 | Kim | D06F 58/16 |

FOREIGN PATENT DOCUMENTS

| | | | |
|---|---|---|---|
| EP | 3450614 | A1 | 3/2019 |

* cited by examiner

*Primary Examiner* — John P McCormack
(74) *Attorney, Agent, or Firm* — Dority & Manning, P.A.

(57) ABSTRACT

A moisture sensor assembly for a dryer appliance includes a housing body having a divider wall, a first sensor rod, and a second sensor rod. The first and second sensor rods are positioned on the housing body. Each of the first and second sensor rods has a mounting tab. The mounting tab of the first sensor rod is positioned opposite the mounting tab of the first sensor rod about the divider wall of the housing body. The mounting tabs of the first and second sensor rods are oriented generally parallel to the divider wall.

18 Claims, 6 Drawing Sheets

DRYER SENSOR ROD WITH ORIENTED TAB

FIELD OF THE INVENTION

The present subject matter relates generally to sensor rods for dryer appliances.

BACKGROUND OF THE INVENTION

Accurately measuring moisture content of clothing being dried within a dryer appliance can improve performance of the dryer appliance. For example, the dryer appliance can be operated until the measured moisture content of the clothing falls below a desired amount. A heater or other appropriate components of the dryer appliance can then be deactivated to avoid inefficient heating of the clothing.

Certain existing dryer appliances use two metal rods in close proximity to each other to detect available moisture in the clothing. Generally, the two separately formed metal rods are mounted to a non-conductive, plastic component in order to electrically isolate the two metal rods from each other. As clothing tumbles within the dryer appliance, the clothing bridges the two metal rods, and a response of a circuit coupled to the two metal rod changes. The response of this circuit can be correlated to the moisture content of the clothing.

Mounting the two metal rods to the plastic component in known dryer appliances had drawbacks. For example, coupling the metal rods to the circuit can be difficult.

BRIEF DESCRIPTION OF THE INVENTION

Aspects and advantages of the invention will be set forth in part in the following description, or may be apparent from the description, or may be learned through practice of the invention.

In a first example embodiment, a dryer appliance includes a drum rotatable about an axis. A housing body is positioned at the drum. The housing body has a divider wall. A moisture sensor is operable to measure moisture content of articles in the drum. The moisture sensor includes a first sensor rod and a second sensor rod. Both of the first and second sensor rods are positioned on the housing body. Each of the first and second sensor rods has a mounting tab. The mounting tab of the first sensor rod is positioned opposite the mounting tab of the first sensor rod about the divider wall of the housing body. The mounting tabs of the first and second sensor rods are oriented generally parallel to the divider wall.

In a second example embodiment, a moisture sensor assembly for a dryer appliance includes a housing body having a divider wall, a first sensor rod, and a second sensor rod. The first and second sensor rods are positioned on the housing body. Each of the first and second sensor rods has a mounting tab. The mounting tab of the first sensor rod is positioned opposite the mounting tab of the first sensor rod about the divider wall of the housing body. The mounting tabs of the first and second sensor rods are oriented generally parallel to the divider wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
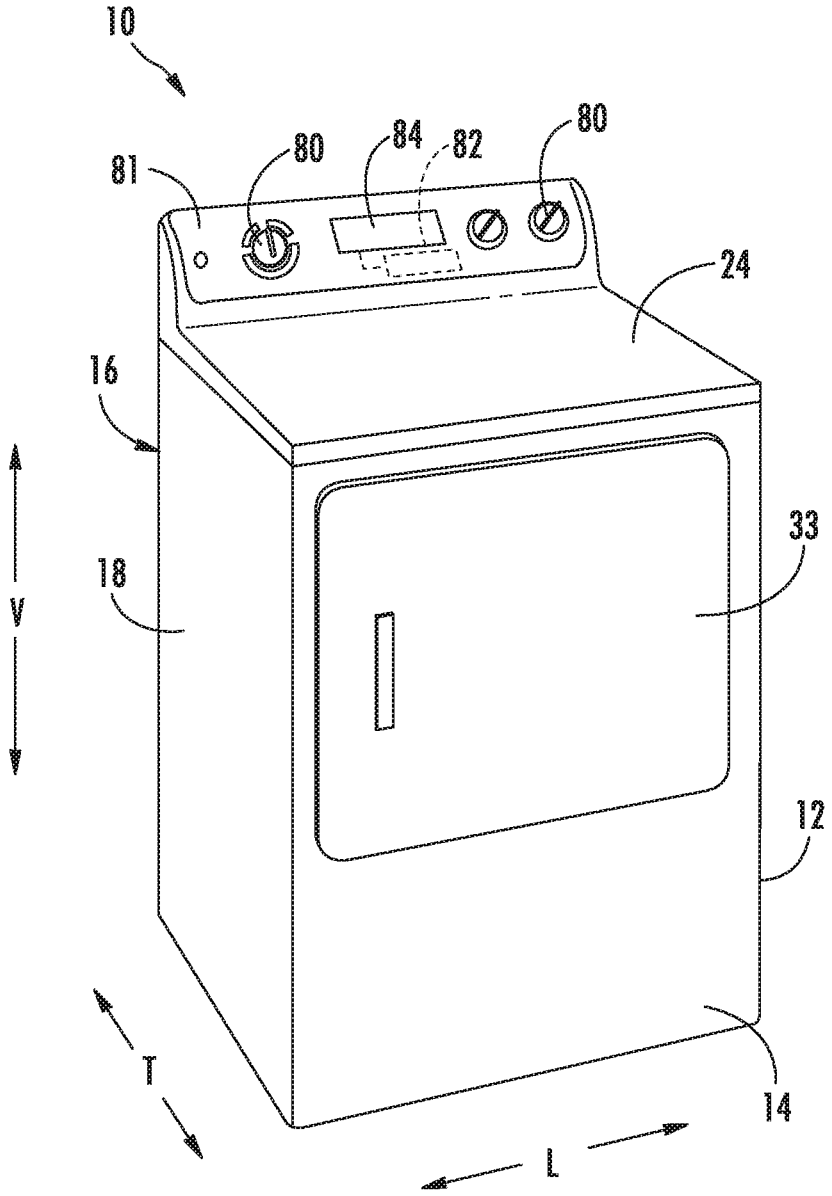
FIG. 1 is a perspective view of a dryer appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
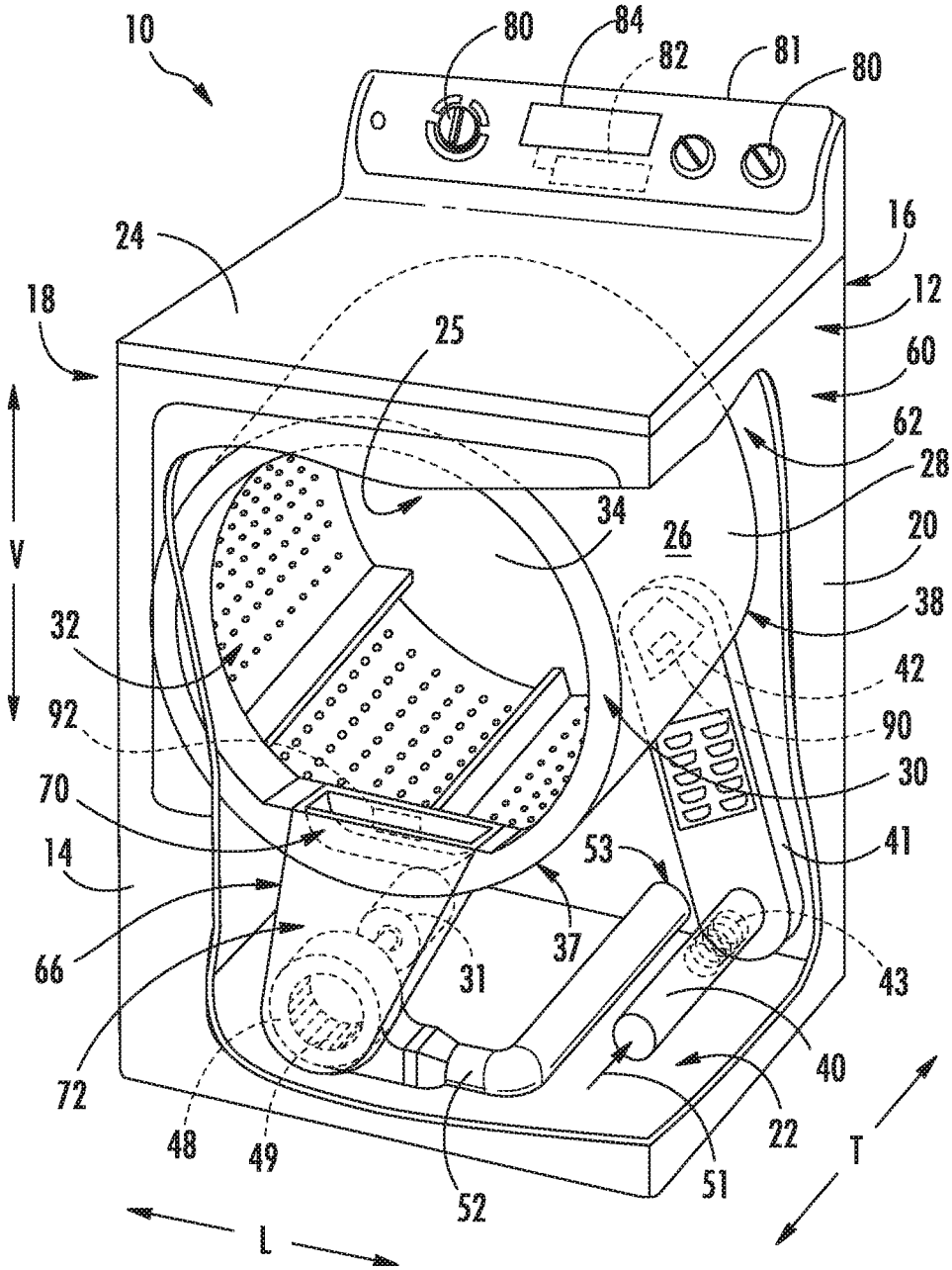
FIG. 2 is a perspective view of the example dryer appliance of FIG. 1 that shows certain internal components of the example dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the transverse direction T. In exemplary embodiments, drum 26 is rotatable, e.g., about an axis that is parallel to the transverse direction T, within cabinet 12.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

A motor 31 may be in mechanical communication with a blower 48 such that motor 31 rotates a blower fan 49 of blower 48. Blower 48 is configured for drawing air through chamber 25 of drum 26, e.g., in order to dry articles located therein, as discussed in greater detail below. In alternative exemplary embodiments, dryer appliance 10 may include an additional motor (not shown) for rotating fan 49 of blower 48 independently of drum 26.

Drum 26 may be configured to receive heated air that has been heated by a heating assembly 40, e.g., in order to dry damp articles disposed within chamber 25 of drum 26. Heating assembly 40 includes a heater 43, such as a gas burner or an electrical resistance heating element, for heating air. As discussed above, during operation of dryer appliance 10, motor 31 rotates fan 49 of blower 48 such that blower 48 draws air through chamber 25 of drum 26. In particular, ambient air enters heating assembly 40 via an entrance 51 due to blower 48 urging such ambient air into entrance 51. Such ambient air is heated within heating assembly 40 and exits heating assembly 40 as heated air. Blower 48 draws such heated air through inlet duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from chamber 25 through an outlet assembly 64 positioned within interior 62. Outlet assembly 64 includes a vent duct 66, blower 48, and an exhaust conduit 52. Exhaust conduit 52 is in fluid communication with vent duct 66 via blower 48. During a dry cycle, internal air flows from chamber 25 through vent duct 66 to blower 48 and through blower 48 to exhaust conduit 52. The internal air is exhausted from dryer appliance 10 via exhaust conduit 52.

In exemplary embodiments, vent duct 66 can include a filter portion 70 and an exhaust portion 72. Exhaust portion 72 may be positioned downstream of filter portion 70 (in the direction of flow of the internal air). A screen filter of filter portion 70 (which may be removable) traps lint and other particulates as the internal air flows therethrough. The internal air may then flow through exhaust portion 72 and blower 48 to exhaust conduit 52. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

In some embodiments, dryer appliance 10 may additionally include one or more sensors. For example, dryer appliance 10 may include one or more temperature sensors 90. Temperature sensor 90 is operable to measure internal temperatures in dryer appliance 10. In some embodiments, for example, temperature sensor 90 may be disposed in inlet duct 41, such as at outlet 42 of inlet duct 41, which corresponds to an inlet to drum 26. Additionally or alternatively, for example, temperature sensor 90 may be disposed in drum 26, such as in chamber 25 thereof, at an outlet of drum 26 such as in vent duct 66, or in any other suitable location within dryer appliance 10. Temperature sensors 90 may be in communication with controller 82, and may transmit readings to controller 82 as required or desired.

Figure 3:
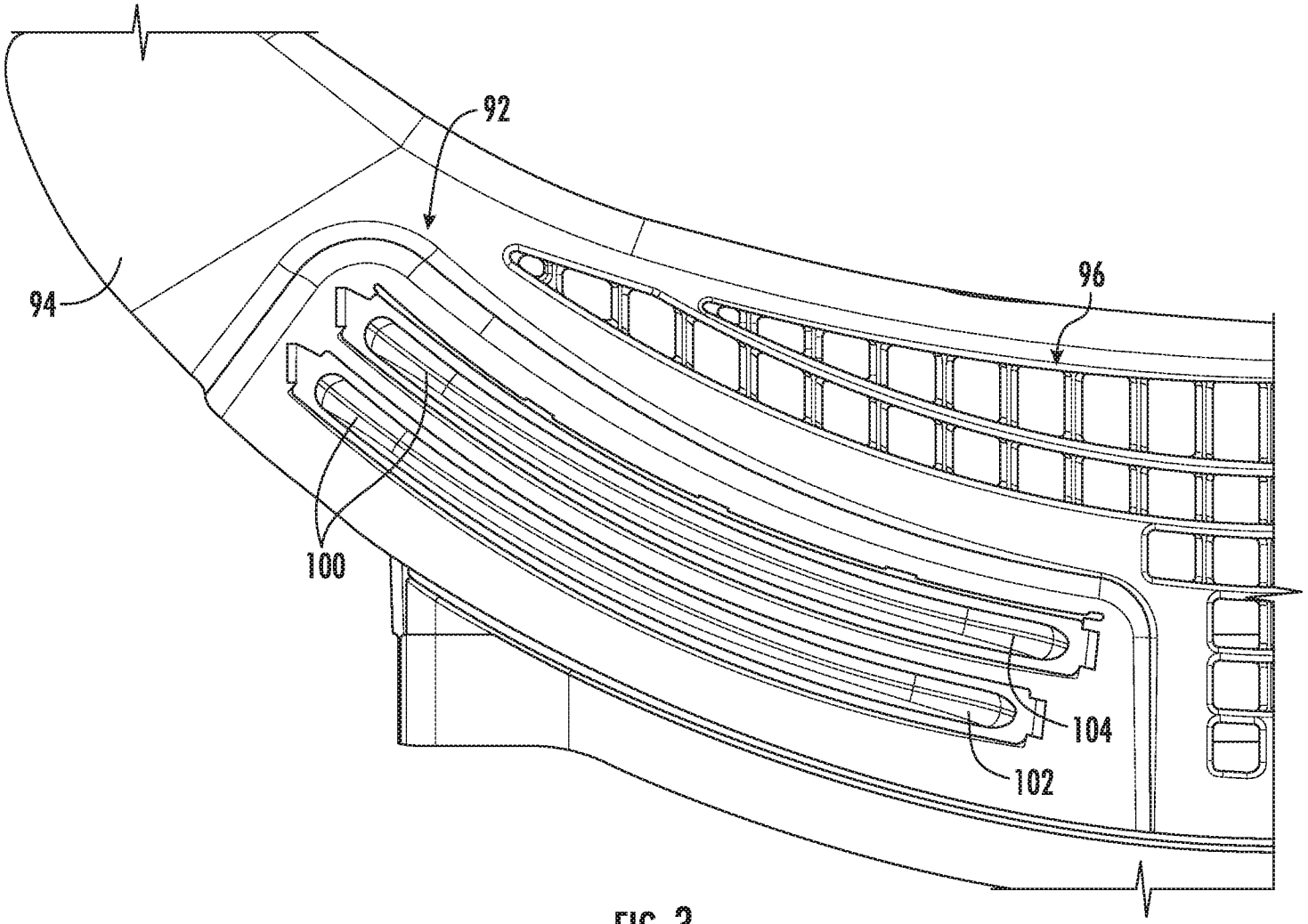
FIG. 3 is a partial, front elevation view of a housing body and a moisture sensor assembly of the example dryer appliance of FIG. 1.

Dryer appliance 10 may further include, for example, a dampness or moisture sensor 92. Moisture sensor 92 is operable to measure the dampness or moisture content of articles within chamber 25 during operation of dryer appliance 10. In particular, moisture sensor 92 may measure voltages associated with dampness or moisture content within the clothing, as is generally understood. In FIG. 3, moisture sensor 92 is shown disposed proximate filter portion 70. In alternative exemplary embodiments, moisture sensor 92 may be disposed at any other suitable location within dryer appliance 10, e.g., on cylinder 28, rear wall 34, etc. Moisture sensor 92 may be in communication with controller 82, and may transmit readings to controller 82 as required or desired.

FIG. 3 provides a partial, elevation view of a housing body 94 and moisture sensor 92 of dryer appliance 10. Housing body 94 may correspond to a front wall adjacent drum 26. Thus, housing body 94 may be positioned at front portion 37 of drum 26 and, e.g., form part a wall below opening 32. Housing body 94 may define a vent grill 96 positioned at or adjacent chamber 25 such that air in chamber 25 is flowable through vent grill 96, e.g., to filter portion 70 behind vent grill 96. Vent grill 96 may include a mesh or grating that defines openings that permit fluid flow through vent grill 96, e.g., from chamber 25 through a lint filter into vent duct 66 as discussed above. In alternative example embodiments, housing body 94 may correspond to any other suitable location within dryer appliance 10, e.g., a portion of cylinder 28, rear wall 34, etc.

As shown in FIG. 3, moisture sensor 92 is mounted to housing body 94. Moisture sensor 92 includes a pair of sensor rods 100, e.g., with a first sensor rod 102 and a second sensor rod 104. First and second sensor rods 102, 104 are positioned on housing body 94, e.g., in close proximity by with first and second sensor rods 102, 104 spaced apart and not contacting each other. Sensor rods 100 may also be positioned such that the elongated bodies 110 (FIG. 4) of sensor rods 100 are positioned within and/or face chamber 25. Thus, damp articles within chamber 25 may contact or touch sensor rods 100. Liquid water within the damp articles may provide a conductive electrical connection between sensor rods 100, and the strength of the conductive electrical connection between sensor rods 100 may be measured to determine the moisture content of the articles within chamber 25. Sensor rods 100 may also be positioned adjacent vent grill 96 on housing body 94.

Figure 4:
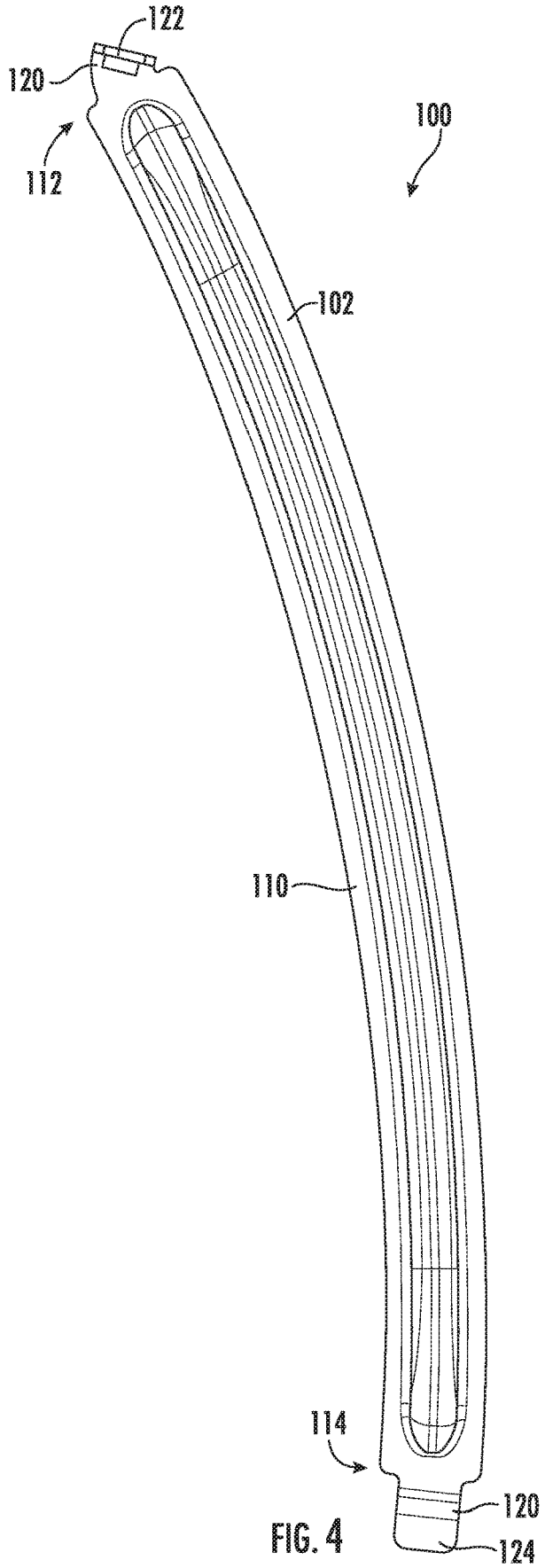
FIG. 4 is a top, plan view of a sensor rod of the moisture sensor assembly of FIG. 3.

FIG. 4 is a top, plan view of one of sensor rods 100, in particular first sensor rod 102. While only one of sensor rods 100 is shown in FIG. 4, it will be understood that both of sensor rods 100, e.g., both of first and second sensor rods 102, 104, may be constructed in the same or similar manner to that shown in FIG. 4. Thus, the description of first sensor rod 102 provided below is equally applicable to second sensor rod 104.

As shown in FIG. 4, first sensor rod 102 includes an elongated body 110 that extends between a first end portion 112 and a second end portion 114. Elongated body 110 of first sensor rod 102 may be sized such that the length of elongated body 110 between first and second end portions 112, 114 of elongated body 110 is (e.g., significantly) greater than the width and/or thickness of elongated body 110 that are perpendicular to the length of elongated body 110. Elongated body 110 may also be curved between first and second end portions 112, 114 of elongated body 110 as shown in FIG. 4. In alternative example embodiments, elongated body 110 may be straight between first and second end portions 112, 114 of elongated body 110.

First sensor rod 102 also includes a pair of mounting tabs 120 having a first mounting tab 122 and a second mounting tab 124. Mounting tabs 120 may be positioned at opposite ends of elongated body 110. For example, first mounting tab 122 may be positioned at first end portion 112 of elongated body 110, and second mounting tab 124 may be positioned at second end portion 114 of elongated body 110. Mounting tabs 120 assist with mounting first sensor rod 102 to housing body 94, as discussed in greater detail below.

Figure 5:
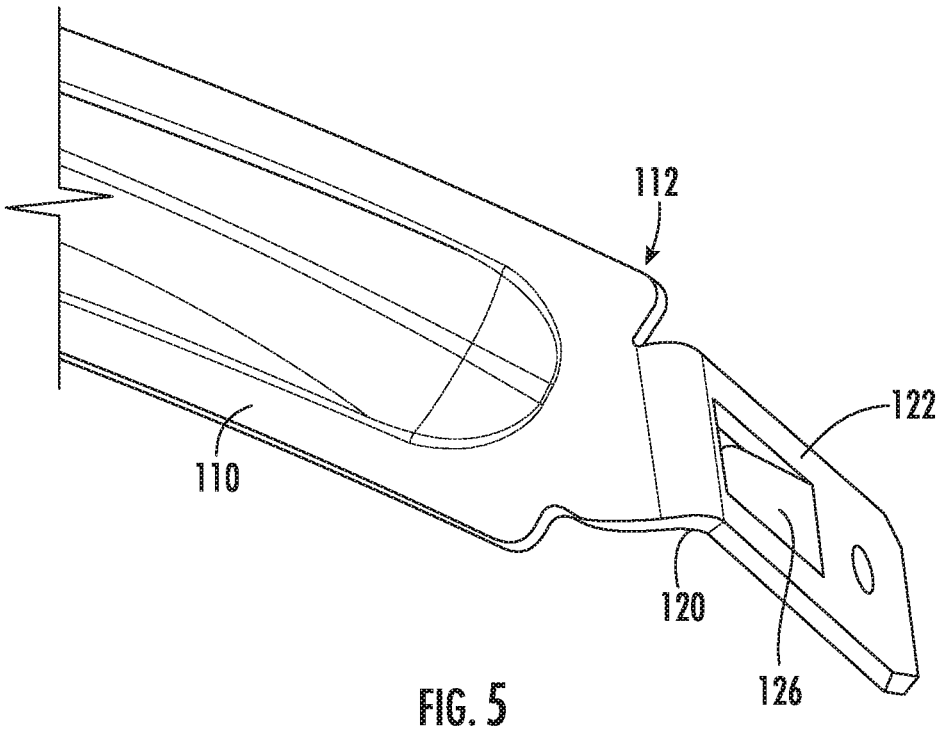
FIGS. 5 and 6 are partial, perspective views of a mounting tab of the sensor rod of FIG. 4.
Figure 6:
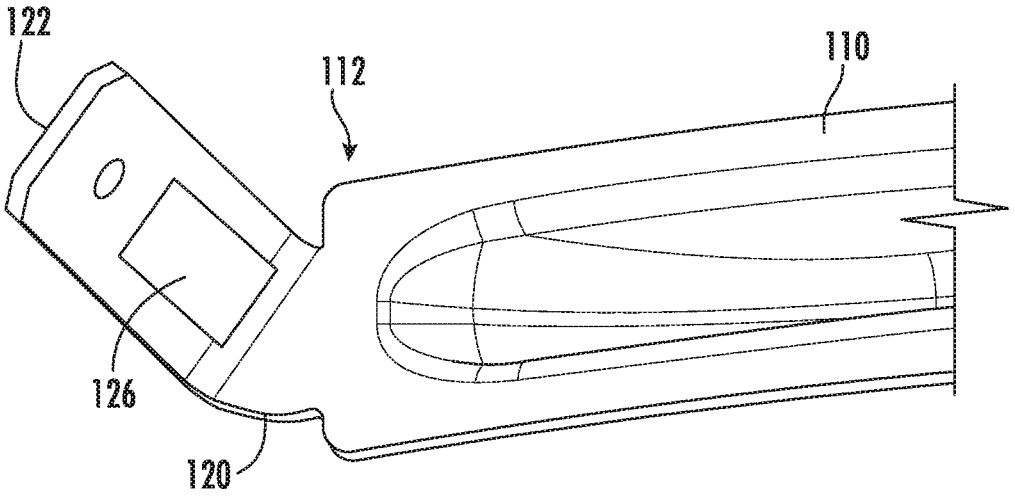

FIGS. 5 and 6 are partial, perspective views of first mounting tab 122 of first sensor rod 112. As may be seen in FIGS. 5 and 6, first mounting tab 122 may be oriented generally perpendicular to elongated body 110 of first sensor rod 112. As used herein, the term "generally" means within ten degrees of the stated angle when used in the context of angles. In particular, first mounting tab 122 may be bent relative to elongated body 110 such that first mounting tab 122 is generally perpendicular to elongated body 110, as shown in FIGS. 5 and 6. First mounting tab 122 also includes a snap-fit clip 126. Snap-fit clip 126 may be cantilevered from first mounting tab 122 such that snap-fit clip 126 is elastically deformable to assist with mounting first sensor rod 102 to housing body 94.

Figure 7:
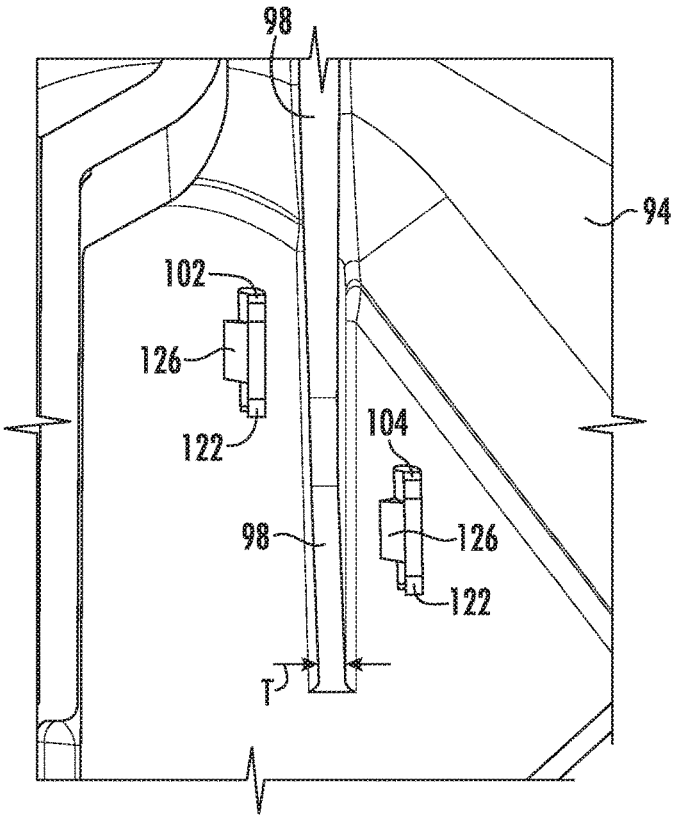
FIG. 7 is a partial, rear elevation view of the mounting tabs of sensor rods of the moisture sensor assembly of FIG. 3.

FIG. 7 is a partial, rear elevation view of first mounting tabs 122 of sensor rods 100. With reference to FIGS. 3 and 7, sensor rods 102 may be mounted to housing body 94 such that elongated bodies 110 of sensor rods 100 are positioned on the side of housing body 94 that faces towards chamber 25. Thus, as noted above, elongated bodies 110 of sensor rods 100 may be positioned for contacting articles in chamber 25. First mounting tabs 122 of sensor rods 100 extend from elongated bodies 110 through housing body 94 to the side of housing body 94 that faces away from chamber 25. Snap-fit clips 126 on first mounting tabs 122 of sensor rods 100 may deflect inwardly as first mounting tabs 122 are inserted through housing body 94, and then snap outwardly after first mounting tabs 122 are inserted through housing body 94. Interference between snap-fit clips 126 and housing body 94 may prevent first mounting tabs 122 from retracting through housing body 94 and thus hold sensor rods 100 on housing body 94.

As shown in FIG. 7, housing body 94 includes a divider wall 98. Divider wall 98 may be positioned opposite elongated bodies 110 of sensor rods 100 on housing body 94. In addition, first mounting tabs 122 of sensor rods 100 are positioned opposite each other about divider wall 98. Thus, divider wall 98 may be positioned between the first mounting tab 122 of first sensor rod 102 and the first mounting tab 122 second sensor rod 104. Divider wall 98 may block or prevent formation of a conductive electrical contact between first mounting tabs 122 of sensor rods 100 (e.g., by water, lint, etc.) at the side of housing body 94 that faces away from chamber 25. Thus, divider wall 98 may assist with preventing inaccurate readings by moisture sensor 92, e.g., due to a bridge between first mounting tabs 122 of sensor rods 100.

First mounting tabs 122 of sensor rods 100 are also oriented generally parallel to divider wall 98. In particular, as shown in FIG. 7, the first mounting tab 122 of first sensor rod 102 may be oriented generally parallel to divider wall 98, and the first mounting tab 122 second sensor rod 104 may also be oriented generally parallel to divider wall 98. As shown in FIG. 7, each first mounting tab 122 of sensor rods 100 may be oriented generally parallel to divider wall 98 such that the surfaces of first mounting tabs 122 with the largest surface area are oriented generally parallel to the respective surface of divider wall 98 that that faces each first mounting tab 122.

Such orientation of first mounting tabs 122 and divider wall 98 may assist with providing an easier connection for sensor rods 100 to an electrical circuit. In addition, such orientation of first mounting tabs 122 and divider wall 98 may allow divider wall 98 to be formed with a suitable thickness. For example, divider wall 98 may advantageously have a thickness T of about six hundredths of an inch (0.06") when first mounting tabs 122 and divider wall 98 are oriented in the manner described above. As used herein, the term "about" means within three hundredths of an inch when used in the context of wall thicknesses. Such thickness for divider wall 98 would not be possible if first mounting tabs 122 where otherwise angled relative to divider wall 98.

Figure 8:
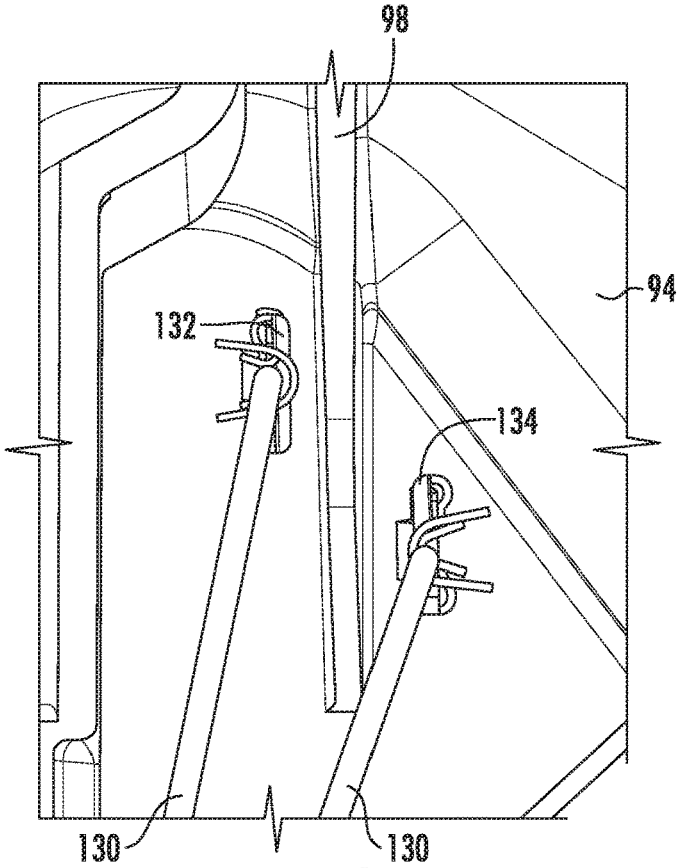
FIG. 8 is a partial, rear elevation view of the mounting tabs of sensor rods of the moisture sensor assembly of FIG. 3 and a jumper harness.

FIG. 8 is a partial, rear elevation view of first mounting tabs 122 of sensor rods 100 and a jumper harness 130. With reference to FIGS. 7 and 8, jumper harness 130 is mounted to first mounting tabs 122 of sensor rods 100. In particular, a first connector 132 of jumper harness 130 may be mounted to first mounting tab 122 of first sensor rod 102, and a second connector 134 of jumper harness 130 may be mounted to first mounting tab 122 of second sensor rod 104. Jumper harness 130 includes suitable wiring for connecting moisture sensor 92 to a circuit for measuring moisture content of articles within chamber 25. As may be seen from the above, of first mounting tabs 122 of sensor rods 100 may correspond to spade terminals or other male terminals for jumper harness 130.

In certain example embodiments, sensor rods 100 are metal sensor rods, and housing body 94 is a plastic housing body. Thus, sensor rods 100 may be formed from an electrical conductor material, and housing body 94 may be formed from an electrical insulator material. First and second sensor rods 102, 104 may also be commonly sized. Thus, each of first and second sensor rods 102, 104 may be formed with a common process, and may be interchangeable. Sensor rods 100 may be formed by a suitable metal stamping process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a drum rotatable about an axis and defining a chamber for receipt of articles for drying;

a housing body positioned at the drum, the housing body having a divider wall; and a moisture sensor operable to measure moisture content of articles in the drum, the moisture sensor comprising a first sensor rod and a second sensor rod, both of the first and second sensor rods positioned on the housing body, wherein each of the first and second sensor rods has a mounting tab, the mounting tab of the first sensor rod positioned opposite the mounting tab of the second sensor rod about the divider wall of the housing body, the mounting tabs of the first and second sensor rods oriented generally parallel to the divider wall, and wherein an elongated body of each of the first and second sensor rods is positioned on a side of the housing body that faces the chamber of the drum, and the divider wall is positioned opposite the elongated bodies of the first and second sensor rods on a side of the housing body that faces away from the chamber of the drum wherein a jumper harness is mounted to the mounting tabs of the first and second sensor rods, and the divider wall blocks conductive electrical contact between the mounting tabs of the first and second sensor rods at the side of the housing body that faces away from the chamber.

2. The dryer appliance of claim 1, wherein the mounting tab of the first sensor rod is positioned at a first end portion of the first sensor rod, and the mounting tab of the second sensor rod is positioned at a first end portion of the second sensor rod.

3. The dryer appliance of claim 2, wherein the mounting tab of the first sensor rod extends through the housing body at the first end portion of the first sensor rod, and the mounting tab of the second sensor rod extends through the housing body at the first end portion of the second sensor rod.

4. The dryer appliance of claim 3, wherein the mounting tab of the first sensor rod includes a snap-fit clip at the first end portion of the first sensor rod, the mounting tab of the second sensor rod includes a snap-fit clip at the first end portion of the second sensor rod, and the snap-fit clips on mounting tabs of the first and second sensor rods hold the first and second sensor rods on the housing body.

5. The dryer appliance of claim 2, wherein each of the first and second sensor rods has an additional mounting tab, the additional mounting tab of the first sensor rod is positioned at a second end portion of the first sensor rod, and the additional mounting tab of the second sensor rod is positioned at a second end portion of the second sensor rod.

6. The dryer appliance of claim 1, wherein the first and second sensor rods are commonly sized.

7. The dryer appliance of claim 1, wherein the housing body defines a grill, and the first and second sensor rods are positioned adjacent the grill on the housing body.

8. The dryer appliance of claim 1, wherein the first and second sensor rods are metal sensor rods, and the housing body is a plastic housing body.

9. The dryer appliance of claim 1, wherein the divider wall has a thickness of about six-hundredths of an inch.

10. A moisture sensor assembly for a dryer appliance, comprising:

a housing body having a divider wall; and a first sensor rod;

a second sensor rod, wherein the first and second sensor rods are positioned on the housing body, and each of the first and second sensor rods has a mounting tab, the mounting tab of the first sensor rod positioned opposite the mounting tab of the second sensor rod about the divider wall of the housing body, the mounting tabs of the first and second sensor rods oriented generally parallel to the divider wall, and wherein an elongated body of each of the first and second sensor rods is positioned on a first side of the housing body, and the divider wall is positioned opposite the elongated bodies of the first and second sensor rods on a second side of the housing body wherein a jumper harness is mounted to the mounting tabs of the first and second sensor rods, and the divider wall blocks conductive electrical contact between the mounting tabs of the first and second sensor rods at the side of the housing body.

11. The moisture sensor assembly of claim 10, wherein the mounting tab of the first sensor rod is positioned at a first end portion of the first sensor rod, and the mounting tab of the second sensor rod is positioned at a first end portion of the second sensor rod.

12. The moisture sensor assembly of claim 11, wherein the mounting tab of the first sensor rod extends through the housing body at the first end portion of the first sensor rod, and the mounting tab of the second sensor rod extends through the housing body at the first end portion of the second sensor rod.

13. The moisture sensor assembly of claim 12, wherein the mounting tab of the first sensor rod includes a snap-fit clip at the first end portion of the first sensor rod, the mounting tab of the second sensor rod includes a snap-fit clip at the first end portion of the second sensor rod, and the snap-fit clips on mounting tabs of the first and second sensor rods hold the first and second sensor rods on the housing body.

14. The moisture sensor assembly of claim 11, wherein each of the first and second sensor rods has an additional mounting tab, the additional mounting tab of the first sensor rod is positioned at a second end portion of the first sensor rod, and the additional mounting tab of the second sensor rod is positioned at a second end portion of the second sensor rod.

15. The moisture sensor assembly of claim 10, wherein the first and second sensor rods are commonly sized.

16. The moisture sensor assembly of claim 10, wherein the housing body defines a grill, and the first and second sensor rods are positioned adjacent the grill on the housing body.

17. The moisture sensor assembly of claim 10, wherein the first and second sensor rods are metal sensor rods, and the housing body is a plastic housing body.

18. The moisture sensor assembly of claim 10, wherein the divider wall has a thickness of about six-hundredths of an inch.

* * * * *